United States Patent [19]

Farrar

[11] Patent Number: 5,044,879

[45] Date of Patent: Sep. 3, 1991

[54] VARIABLE STATOR VANE ARRANGEMENT FOR AN AXIAL FLOW COMPRESSOR

[75] Inventor: Peter G. G. Farrar, Derby, England

[73] Assignee: Rolls-Royce plc, Derby, England

[21] Appl. No.: 440,362

[22] Filed: Nov. 22, 1989

[30] Foreign Application Priority Data

Jan. 25, 1989 [GB] United Kingdom ..... 8901569

[51] Int. Cl.[5] ..... F01D 17/00

[52] U.S. Cl. ..... 415/150; 415/162

[58] Field of Search ..... 415/148, 149.1, 149.2, 415/150, 159, 160, 161, 162

[56] References Cited

U.S. PATENT DOCUMENTS

| | | | |
|---|---|---|---|
| 2,613,029 | 10/1952 | Wilde | 415/149.2 |
| 2,929,546 | 3/1960 | Wilkes, Jr. | 415/160 |
| 3,377,799 | 4/1968 | Geyer | 415/160 |
| 3,502,260 | 3/1970 | Koff | 415/148 |
| 3,685,920 | 8/1972 | Burge | 415/160 |
| 4,874,287 | 10/1989 | Grieb | 415/162 |

FOREIGN PATENT DOCUMENTS

| | | | |
|---|---|---|---|
| 59400 | 4/1983 | Japan | 415/162 |
| 1511723 | 5/1975 | United Kingdom . | |
| 2003988 | 3/1979 | United Kingdom | 415/162 |
| 2078865 | 6/1980 | United Kingdom . | |

*Primary Examiner*—John T. Kwon

*Attorney, Agent, or Firm*—Cushman, Darby & Cushman

[57] ABSTRACT

A variable stator vane arrangement for an axial flow compressor comprises a plurality of stages of variable pitch stator vanes each of which is operated by a respective control ring. The vanes in each stage are connected to the control rings by operating levers. An axially extending member is connected to each control ring by operating links. The axially extending member is arranged in a plane substantially tangential to each control ring and is movable in the plane substantially tangential to the control rings to change the pitch of the variable pitch stator vanes. Hydraulic rams are provided to move the axially extending member. The hydraulic rams may be operated to give either proportional or non-proportional movement of the variable pitch stator vanes. A controller may use signals from position detectors positioned on the control rings or position detectors positioned on the hydraulic rams together with compressor parameters to control the pitch of the vanes.

19 Claims, 2 Drawing Sheets

VARIABLE STATOR VANE ARRANGEMENT FOR AN AXIAL FLOW COMPRESSOR

BACKGROUND OF THE INVENTION

1. Field of the Invention

The present invention relates to a variable pitch stator vane arrangement for an axial flow compressor, particularly an axial flow compressor for gas turbine engines.

2. Background Information

Generally in prior art axial flow compressors with several stages of variable pitch stator vanes, at the designed operating condition of the compressor all the stages of variable stator vanes are operating at maximum efficiency and each stage of stator vanes has a surge margin. However, when the compressor is operating at conditions in which the rotational speed of the compressor rotor is lower than the designed rotational speed of the compressor rotor it is necessary to vary the angles of the stator vanes to prevent surge or stall of the compressor. It has been found that in high pressure ratio compressors i.e. pressure ratios of the order of 12 to 1 or more, that the variation of the angles of the stator vanes in the presently accepted manner has tended to make any surge or stall worse.

The presently accepted method of varying the angles of the stator vanes uses a proportional method in which the variable stator vanes in each stage are moved a proportion or fraction of their full designed angular displacement. The variable stator vanes in each stage are all moved through the same proportion of their full designed angular movement in unison.

Recent advances in axial flow compressors have brought about the requirement for methods of varying the angles of the stator vanes in a non-proportional method in which the variable stator vanes in each stage are moved a proportion, or fraction, of their full designed angular displacement, but the variable stator vanes in each stage are moved independently of the other variable stator vanes in the other stages. This method has overcome the problem of surge or stall in axial flow compressors of high pressure ratio when operating at conditions of low rotational speeds of the compressor rotor.

A third method of varying the angles of the stator vanes is to move the stator vanes in a non-proportional method in which the variable stator vanes in each stage are moved a proportion, or fraction, of their full designed angular displacement, but the variable stator vanes in each stage are all moved through different proportions of their designed angular movement in unison.

SUMMARY OF THE INVENTION

The present invention seeks to provide a novel variable switch stator vane arrangement for an axial flow compressor which may be used to give a proportional movement of the variable stator vanes or a non-proportional movement of the variable stator vanes.

Accordingly, the present invention provides a variable stator vane arrangement for an axial flow compressor comprising a plurality of stages of stator vanes. Each stage of stator vanes has a plurality of circumferentially arranged radially extending stator vanes mounted for rotation about their longitudinal axes in a stator structure. A plurality of these control rings has arranged substantially coaxial with the compressor and surrounding the stator structure, the stator vanes in each stage being connected to a respective one of plurality of control rings by operating levers. Each of the control rings is connected to an axially extending member by an operating link, the axially extending member being movable in a plane substantially tangential to and positioned substantially tangential to each of the control rings such that at least one of the control rings is rotated coaxially of the compressor to change the pitch of the stator vanes in the associated stage of stator vanes.

Actuator means may be arranged to move the axially extending member substantially tangentially to the control rings.

The actuator means may comprise a pair of actuators connected to the axially extending member, the actuators being connected to the axially extending member at axially spaced locations.

Stop means may be provided to limit the tangential movement of the axially extending member.

The stop means may comprise a first pair of stop members secured to the stator structure and positioned in the plane tangential to the control rings on either side of a first end of the axially extending member and a second pair of stop members secured to the stator structure and positioned in the plane tangential to the control rings on either side of a second end of the axially extending member.

The axially extending member may be substantially straight.

The axially extending member may be curved such that the axially extending member has portions arranged in planes tangential to each control ring.

The axially extending member may be stepped such that the axially extending member has portions arranged in planes tangential to each control ring.

The actuator means may be hydraulic rams.

The actuator means may be ball screw actuators.

The actuator means may be electric stepper motors.

The actuator means may be movable in unison in the same direction to vary the pitch of the stator vanes in each stage at the same time and to vary the pitch of the stator vanes in each stage through the same proportion of their pitch change movement.

The actuator means may be movable to vary the pitch of the stator vanes in each stage non-proportionally.

Position detectors may detect the pitch of the variable stator vanes of at least two of the stages of variable stator vanes, the position detectors producing electrical signals indicative of the pitch of the variable stator vanes, a controller analyzes the electrical signals indicative of the pitch of the variable stator vanes to produce control signals to operate the actuator means.

The position detectors may be located on the control rings of the at least two stages of variable stator vanes.

The position detectors may be located on the actuator means to determine the position of the actuator means.

The position detectors may be located on the vanes of the at least two stages of variable stator vanes.

The controller may compare detected compressor parameters with predetermined characteristics of the compressor and determines any adjustments necessary to the stages of variable stator vanes to more nearly match the compressor parameters with the predetermined characteristics of the compressor.

BRIEF DESCRIPTION OF THE DRAWINGS

The present invention will be more fully described by way of example with reference to the accompanying drawings, in which.

DETAILED DESCRIPTION OF THE PREFERRED EMBODIMENTS

Figure 1:
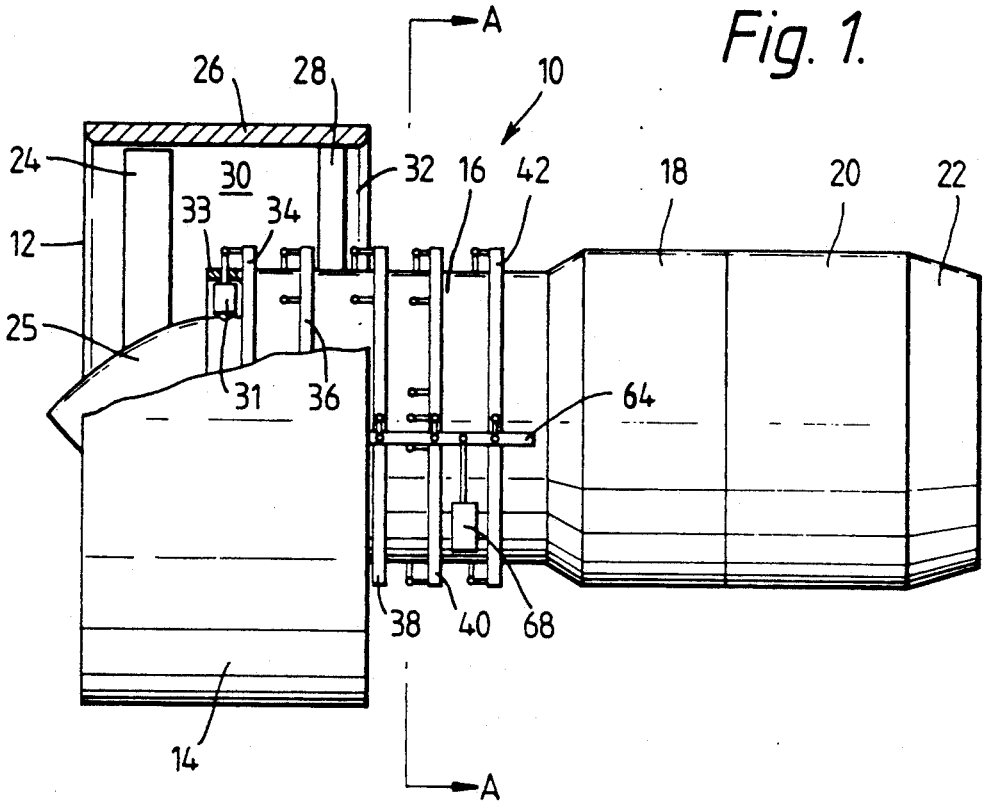
FIG. 1 is a partially cut away view of a turbofan gas turbine engine having a variable stator vane arrangement for an axial flow compressor according to the present invention.

A turbofan gas turbine engine 10 is shown in FIG. 1 and comprises in axial flow series an air intake 12, a fan assembly 14, a compressor assembly 16, a combustor assembly 18, a turbine assembly 20 and an exhaust nozzle 22. The fan assembly 14 comprises a plurality of fan blades 24 secured to and extending radially from a fan rotor 25. The fan blades 24 and fan rotor 25 are enclosed by a fan casing 26, which partially defines a fan duct 30. The fan casing 26 is secured to the core engine casing by fan duct outlet guide vanes 28. The fan duct 30 has an exhaust nozzle 32 at its downstream end.

Figure 6:
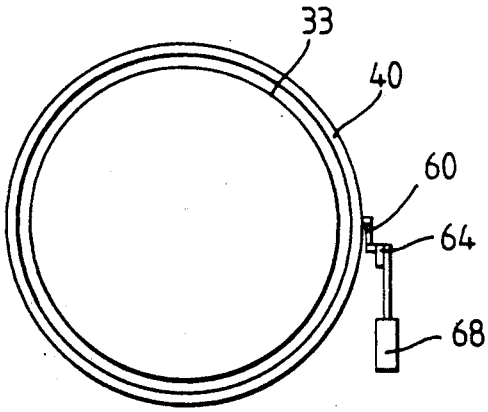
FIG. 6 is a sectional view in the direction of arrows A in FIG. 1.

The compressor assembly 16 comprises a number of stages of stator vanes and a number of stages of rotor blades (not shown). The stages of stator vanes and rotor blades are arranged axially alternately. A plurality of the stages of the stator vanes, in this example five stages, are of the variable type. Each of the stages of variable stator vanes comprises a plurality of circumferentially arranged radially extending stator vanes 31. The stator vanes 31 are mounted for rotation about their longitudinal axis in a stator casing 33. A plurality of control rings 34,36,38,40 and 42 are arranged substantially coaxial with the compressor assembly 16, and surround the stator casing 33. The stator vanes 31 in each stage of variable stator vanes are connected to a respective one of the plurality of control rings 34,36,38,40 and 42 by operating levers 44,46,48,50 and 52 respectively which are shown more clearly in FIGS. 2 and 6.

Each of the control rings 34,36,38,40 and 42 is connected to an axially extending member 64 by operating links 54,56,58,60 and 62 respectively. The operating links 54,56,58,60 and 62 extend substantially tangentially with respect to their associated control rings 34,36,38,40 and 42, and the axially extending member 64 is arranged in planes substantially tangential to the control rings 34,36,38,40 and 42.

A first hydraulic ram 66 and a second hydraulic ram 68 are provided to move the axially extending member 64. The first and second hydraulic rams 66 and 68 are connected to the axially extending member 64 at axially spaced locations.

The ends 67 and 69 of the axially extending member 64 are positioned between end stop members 70,72 and 74,76 which are arranged in the plane substantially tangential to the control rings. The axially extending member 64 has a slot 65 at the position where the hydraulic ram 68 is connected to the axially extending member 64 to allow some relative movement therebetween.

A position detector 78 is located on the control ring and a position detector 80 is located on the control ring 42, the position detectors 78,80 detect the pitch or angle setting of the vanes and, are arranged to produce electrical signals which are transmitted to a controller 94 via cables 82,84. A position detector 86 is located on the hydraulic ram 66 and a position detector 88 is located on the hydraulic ram 68, the position detectors 86,88 detect the position of the pistons in the hydraulic rams, and are arranged to produce electrical signal which are transmitted to the controller 94 via cables 90,92.

The controller 94 is arranged to receive various engine parameters, for example air flow through the compressor, pressure ratio across the compressor, and to compare these with the desired characteristics of the engine. The controller 94 also uses the electrical signals from the position detectors to determine the position of the pitch of the vanes in each stage of variable stator vanes, and to determine the position of the pistons in the hydraulic rams. The controller 94 determines any adjustment that is necessary to the stages of variable stator vanes in order to match the engine parameters with the desired characteristics of the engine, and the controller 94 control the flow of hydraulic fluid to the hydraulic rams 66 and 68.

In operation the axially extending member 64 is moved in the plane substantially tangential to the control rings 34,36,38,40 and 42 to rotate the control rings coaxially of the compressor such that the pitch of the variable stator vanes 31 in the stages of variable stator vanes is varied.

The hydraulic rams 66 and 68 may be moved in unison in the same direction such that there is a proportional movement of the variable stator vanes 31 in each stage. The hydraulic rams 66 and 68 may be moved through various distances such that there is a non-proportional movement of the variable stator vanes 31 in different stages. The controller 94 controls the hydraulic fluid to the hydraulic rams 66,68 necessary for these movements. The controller 94 is able to cause all the control rings to rotate in the same direction, or to cause some control rings to rotate in opposite directions. The controller is able to cause predetermined control rings to remain stationary or to be delayed in action before commencing to rotate.

The arrangement of the variable stator vanes, control rings, axially extending member, hydraulic rams and controller enables differential movement of the variable stator vanes, the characteristics of the differential movement are controlled by the control logic of the controller for different operating conditions for example low speed, high speed and different transient rates.

The arrangement is also suitable for varying the stator vanes in a non-proportional manner in which the variable stator vanes in each stage are moved a proportion of their full designed angular displacement, but the variable stator vanes in each stage are all moved through different proportions of their designed angular movement in unison.

The controller 94 may use the position detectors 86,88 which detect the positions of the pistons in the hydraulic rams to give an indication of the pitch of the vanes in each stage of variable stator vanes 31. However for greater accuracy the controller 94 uses the position detectors 78,80 which detect the positions of the control rings 34,42 to determine the pitch of the vanes in each stage of variable stator vanes. It may be possible to use position detectors located on more than two control rings. Alternatively to obtain most accuracy the detectors may be located on the vanes themselves in two or more of the stages of variable stator vanes. It may be possible to have mixed arrangements of position detectors, for example it may be possible to use position detector 78 on the control ring 34 and position detector 88 on the hydraulic ram 68, or position detector 86 on hydraulic ram 66 and position detector 80 on control ring 42.

It may be possible to use other actuator means for example pneumatic rams, electric stepper motors or ball screw actuators. In each case the controller controls the operation of the actuator means.

Figure 2:
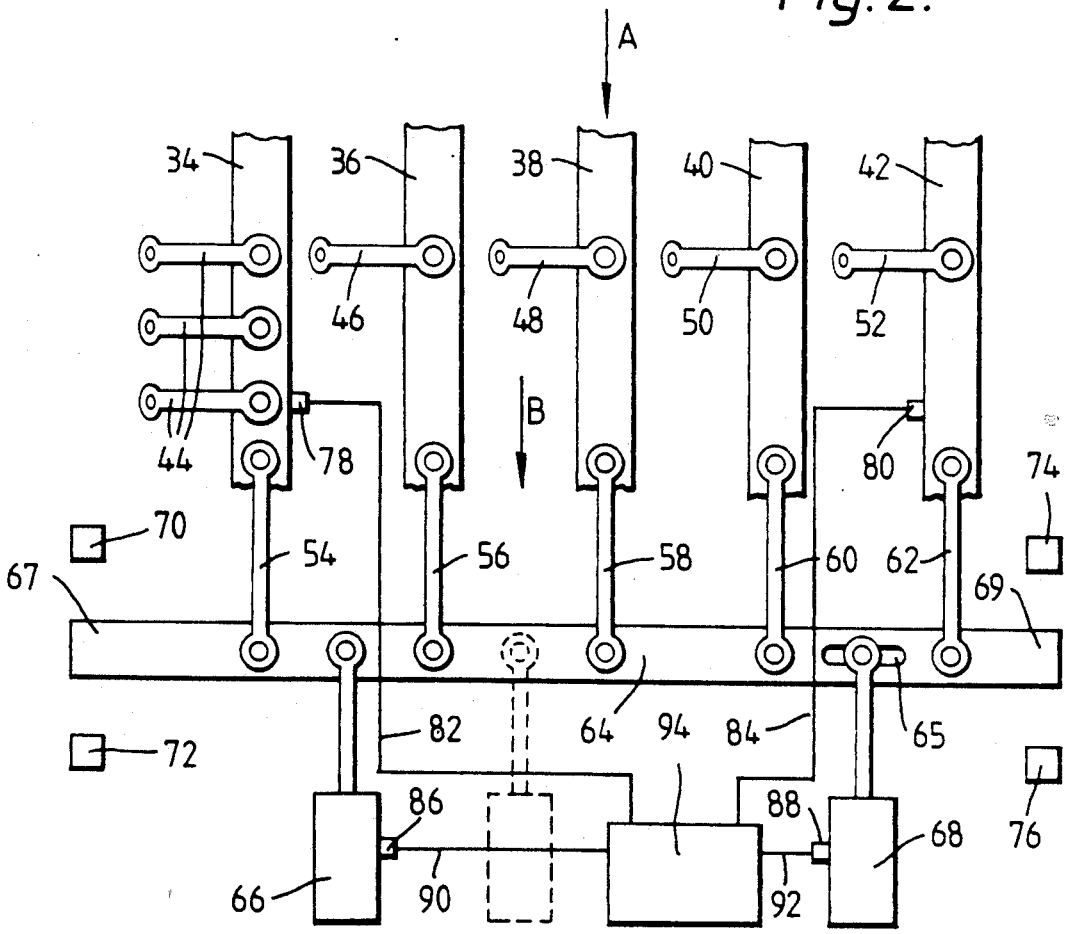
FIG. 2 is an enlarged view of a part of the variable stator vane arrangement shown in FIG. 1.
Figure 3:
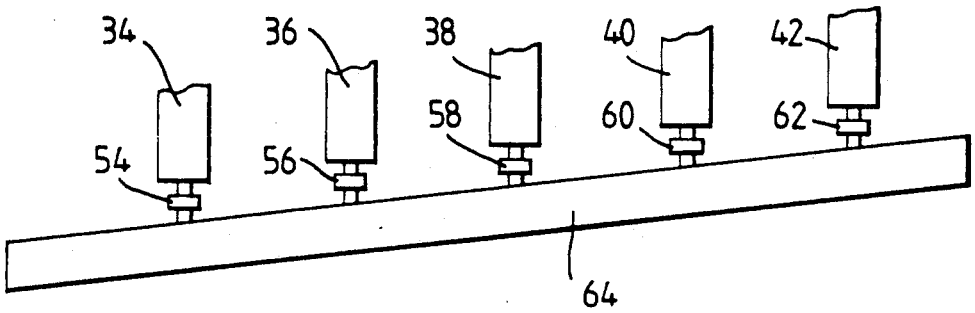
FIG. 3 is a view in the direction of arrow B in FIG. 2.
Figure 4:
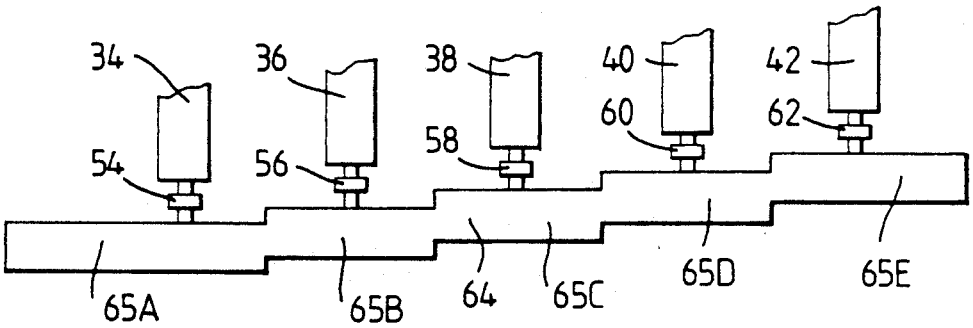
FIG. 4 is a view in the direction of arrow B in FIG. 2 showing an alternative embodiment.
Figure 5:
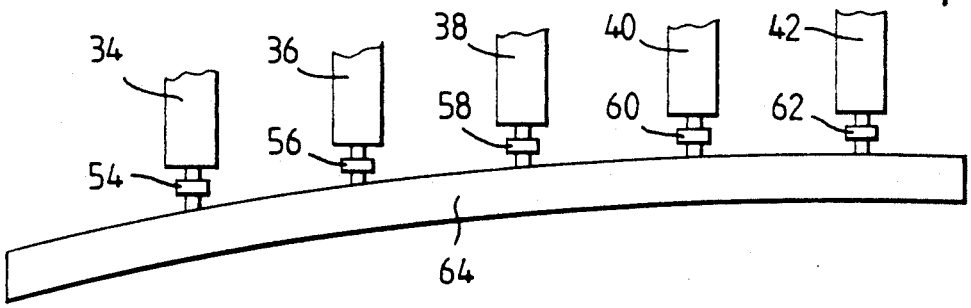
FIG. 5 is a view in the direction of arrow B in FIG. 2 showing a further embodiment.

FIGS. 3, 4 and 5 show alternative views in the direction of arrow A in FIG. 2 of the axially extending member 64. In FIG. 3 the axially extending member is substantially straight and the links 54,56,58,60 and 62 connect the axially extending member 64 to the control rings 34,36,38,40 and 42. The control rings are of decreasing diameter in a downstream direction, and therefor the axially extending member is inclined at an angle to the axial direction. In FIG. 4 the axially extending member 64 comprises a number of axially extending portions 65A, 65B, 65C, 65D and 65E which are arranged offset from each other to form a stepped structure. Each of the portions 65A to 65E is arranged in a plane substantially tangential to the respective control ring. In FIG. 5 the axially extending member is curved such that portions of the axially extending member immediately adjacent each control ring are arranged in planes tangential to the respective control ring. It is also possible for a single axially extending member to comprise suitable combinations of any two, or more of axially straight, curved and stepped portions.

I claim:

1. A variable pitch stator vane arrangement for an axial flow compressor comprising:

a stator structure;

a plurality of stages of stator vanes, each stage of stator vanes having a plurality of circumferentially arranged radially extending stator vanes, each stator vane having a longitudinal axis, each stator vane being mounted to the stator structure for rotation about its longitudinal axis so that each stator vane has a variable pitch;

a plurality of control rings being arranged substantially coaxial with the compressor and surrounding the stator structure;

a plurality of operating levers, the stator vanes in each stage being connected to a respective one of the plurality of control rings by the operating levers;

an axially extending member positioned in a plane substantially tangential to each of the control rings, the axially extending member having a first end and a second end, the first and second ends being movable with respect to the stator structure but independently of said stator structure;

a plurality of operating links, each control ring being connected to the axially extending member by a respective one of the operating links; and an actuator means for moving the axially extending member in the plane substantially tangential to the control rings, the actuator means comprising a first actuator connected to the axially extending member at a first location and a second actuator connected to the axially extending member at a second axially spaced location, the axially extending member being movable by the actuators in the plane substantially tangential to each of the control rings such that at least one of the control rings is rotated coaxially of the compressor to change the pitch of the stator vanes in the associated stage of stator vanes by rotating the stator vanes about their longitudinal axes.

2. A variable pitch stator vane arrangement for an axial flow compressor as claimed in claim 1 in which stop means are provided to limit the tangential movement of the axially extending member.

3. A variable pitch stator vane arrangement for an axial flow compressor as claimed in claim 2 in which the stop means comprises a first pair of stop members secured to the stator structure and positioned in the plane tangential to the control rings on either side of a first end of the axially extending member and a second pair of stop members secured to the stator structure and positioned in the plane tangential to the control rings on either side of a second end of the axially extending member.

4. A variable pitch stator vane arrangement for an axial flow compressor as claimed in claim 1 in which the axially extending member is substantially straight.

5. A variable pitch stator vane arrangement for an axial flow compressor as claimed in claim 1 in which the axially extending member is curved, such that the axially extending member has portions arranged in planes tangential to each control ring.

6. A variable pitch stator vane arrangement for an axial flow compressor as claimed in claim 1 in which the axially extending member is stepped such that the axially extending member has a portion arranged in plane tangential to each control ring.

7. A variable pitch stator vane arrangement for an axial flow compressor as claimed in claim 1 in which the actuators are hydraulic rams.

8. A variable pitch stator vane arrangement for an axial flow compressor as claimed in claim 1 in which the actuators are ball screw actuators.

9. A variable pitch stator vane arrangement for an axial flow compressor as claimed in claim 1 in which the actuators are electric stepper motors.

10. A variable pitch stator vane arrangement for an axial flow compressor as claimed in claim 1 in which the actuators are movable in unison in the same direction to vary the pitch of the stator vanes in each stage at the same time to vary the pitch of the stator vanes in each stage through the same proportion of their pitch change movement.

11. A variable pitch stator vane arrangement for an axial flow compressor as claimed in claim 1 in which the actuator means are movable to vary the pitch of the stator vanes in each stage nonproportionally.

12. A variable pitch stator vane arrangement for an axial flow compressor as claimed in claim 1 in which position detectors detect the pitch of the variable stator vanes of at least two of the stages of variable stator vanes, the position detectors producing electrical signals indicative of the pitch of the variable stator vanes, a controller analyzes the electrical signals indicative of the pitch of the variable stator vanes to produce control signals to operate the actuator means.

13. A variable pitch stator vane arrangement for an axial flow compressor as claimed in claim 12 in which the position detectors are located on the control rings of the at least two stages of variable stator vanes.

14. A variable pitch stator vane arrangement for an axial flow compressor as claimed in claim 12 in which the position detectors are located on the actuators to determine the position of the actuators.

15. A variable pitch stator vane arrangement for an axial flow compressor as claimed in claim 14 in which the controller compares detected compressor parameters with predetermined characteristics of the compressor, and determines any differences between the detected compressor parameters and the predetermined characteristics of the compressor, the controller producing control signals to adjust the pitches of the stator vanes of the stages of variable stator vanes to more nearly match the compressor parameters with the predetermined characteristics of the compressor.

16. A variable pitch stator vane arrangement for an axial flow compressor as claimed in claim 1 wherein the axially extending member is movable by the actuators so that some of the plurality of control rings rotate coaxially of the compressor in a first direction while other of the plurality of control rings rotate coaxially of the compressor in second direction opposite the first direction.

17. A variable pitch stator vane arrangement for an axial flow compressor as claimed in claim 16 wherein the axially extending member is movable by the actuators so that one of the plurality of control rings remains stationary.

18. A variable pitch stator vane arrangement for an axial flow compressor as claimed in claim 17 wherein the axially extending member is also movable by the actuators so that all of the plurality of control rings rotate coaxially of the compressor.

19. A variable pitch stator vane arrangement for an axial flow compressor as claimed in claim 1 wherein the first actuator can be extended to push the axially extending member at the first location and wherein the second actuator can be simultaneously retracted to pull the axially extending member at the second location.

* * * * *